US010184490B2

(12) United States Patent
Fang et al.

(10) Patent No.: US 10,184,490 B2
(45) Date of Patent: Jan. 22, 2019

(54) NOISE REDUCTION DIFFUSER FOR AN ELECTRIC BLOWER

(71) Applicant: Johnson Electric S.A., Murten (CH)

(72) Inventors: Chuan Hui Fang, Shen Zhen (CN); Ming Ju Chen, Shen Zhen (CN); Hong Guang Li, Shen Zhen (CN)

(73) Assignee: JOHNSON ELECTRIC S.A., Murten (CH)

( * ) Notice: Subject to any disclaimer, the term of this patent is extended or adjusted under 35 U.S.C. 154(b) by 331 days.

(21) Appl. No.: 15/043,178

(22) Filed: Feb. 12, 2016

(65) Prior Publication Data

US 2016/0238033 A1 Aug. 18, 2016

(30) Foreign Application Priority Data

Feb. 13, 2015 (CN) ..... 2015 1 0080941

(51) Int. Cl.

| | |
|---|---|
| ***F04D 29/66*** | (2006.01) |
| ***F04D 29/54*** | (2006.01) |
| ***F04D 29/32*** | (2006.01) |
| ***F04D 17/16*** | (2006.01) |
| ***F04D 25/06*** | (2006.01) |

(52) U.S. Cl.

CPC ..... *F04D 29/665* (2013.01); *F04D 17/165* (2013.01); *F04D 25/0606* (2013.01); *F04D 29/325* (2013.01); *F04D 29/542* (2013.01)

(58) Field of Classification Search

CPC ..... F04D 29/665; F04D 19/002; F04D 25/06; F04D 29/3325; F04D 29/522; F04D 29/58; F04D 29/542

See application file for complete search history.

(56) References Cited

U.S. PATENT DOCUMENTS

| | | | | |
|---|---|---|---|---|
| 4,596,921 | A | 6/1986 | Hersh et al. | |
| 6,896,095 | B2 | 5/2005 | Shah et al. | |
| 9,637,210 | B2 * | 5/2017 | Thomson | F04D 25/06 |
| 2005/0220640 | A1 * | 10/2005 | Finkenbinder et al. | F04D 29/444 417/423.3 |
| 2007/0025848 | A1 * | 2/2007 | Shawcross et al. | F04D 29/444 415/208.2 |

FOREIGN PATENT DOCUMENTS

| | | |
|---|---|---|
| EP | 2 327 327 A1 | 6/2011 |

* cited by examiner

*Primary Examiner* — Kevin Lee
(74) *Attorney, Agent, or Firm* — Muncy, Geissler, Olds & Lowe, P.C.

(57) ABSTRACT

A noise reduction diffuser for an electric blower has a motor holder and a rear cover fitted to the motor holder. The motor holder includes a sidewall and a bottom portion at one end of the sidewall. The other end of the sidewall has an opening for mounting an electric motor inside the sidewall. An output shaft of the motor extends through the bottom portion for driving a fan. The motor holder and the rear cover form a Helmholtz resonance cavity.

17 Claims, 2 Drawing Sheets

NOISE REDUCTION DIFFUSER FOR AN ELECTRIC BLOWER

CROSS REFERENCE TO RELATED APPLICATIONS

This non-provisional patent application claims priority under 35 U.S.C. § 119(a) from Patent Application No. 201510080941.5 filed in The People's Republic of China on Feb. 13, 2015, the entire contents of which are hereby incorporated by reference.

FIELD OF THE INVENTION

This invention relates to an electric blower having a reduced noise and to a noise reduction diffuser for an electric blower.

BACKGROUND OF THE INVENTION

An electric blower is a unit incorporating a fan driven by an electric motor. Electric blowers have many uses where it is desired to move air or to generate a flow of air. A hair dryer is a common example of an electric blower, that incorporates a heating element to warm the air flow Other examples include electric fans and heat guns, as used in industrial, packaging and artistic fields.

During use, the electric blowers generate a large amount of noise, produced by vibration of the motor, the rotation of the fan blades and swirling of air inside of the blower. This noise can be loud enough to cause discomfort for the user and annoy others nearby.

SUMMARY OF THE INVENTION

Hence there is a desire for an electric blower with emits less noise.

Accordingly, in one aspect thereof, the present invention provides a noise reduction diffuser, comprising: a motor holder including: a cylindrical sidewall having a first end and a second end; a bottom portion at the first end of the sidewall; an opening formed in the second end of the sidewall for allowing a motor to be mounted inside the sidewall; and a plurality of guide vanes is disposed on the sidewall of the motor holder, for guiding airflow over the cylindrical sidewall of the motor holder; and a rear cover having a bottom portion and a conical sidewall extending from the bottom portion, the conical sidewall has an outer diameter that increases away from the bottom portion, an open end of the conical sidewall is fixed to and closes the opening of the second end of the cylindrical sidewall of the motor holder, wherein the rear cover cooperates with the motor holder to form a Helmholtz resonance cavity.

Preferably, the sidewall of the motor holder is formed with a plurality of first apertures.

Preferably, the sidewall of the rear cover is formed with a plurality of second apertures.

Preferably, an inner diameter of the sidewall of the motor holder is greater than an outer diameter of the motor, such that a gap is formed between the sidewall of the motor holder and the motor, and the first apertures pass through the entire thickness of the sidewall of the motor holder to be in communication with the gap.

Preferably, the thickness of the first apertures and the second apertures is 0.0005 to 0.005 m.

Preferably, the first apertures and the second apertures satisfy the following conditions: $N_kS_k/S_a$=0.01~0.2, k is 1 or 2, $N_k$ represents the number of the apertures, and $S_k$ represents the area of a single second aperture; when k is 1, $S_{ak}$ represents an outer surface area of the sidewall of the motor holder, and $N_kS_k$ represents the total area of the first apertures; when k is 2, $N_kS_k$ represents the total area of the second apertures, and $S_{ak}$ represents an outer surface area of the sidewall of the rear cover.

Preferably, the conical sidewall of the rear cover includes a first sidewall portion and a second sidewall portion that are interconnected to each other, the first sidewall portion extends from the bottom portion of the rear cover and has an outer diameter that gradually increases, the second sidewall portion extends from a distal end of the first sidewall portion and has an outer diameter that gradually increases, and a rate of increase of the outer diameter of the second sidewall portion is greater than that of the first sidewall portion, such that the rear cover overall is shaped like a hat.

According to a second aspect, the present invention provides an electric blower comprising an outer housing, and an air supply unit disposed inside the outer housing, wherein the air supply unit comprises: a noise reduction diffuser as described above; a motor mounted in the diffuser; and an impeller disposed at an outer end of the diffuser and driven by the motor.

Preferably, a heat generating unit is disposed inside the outer housing to heat an airflow produced by the air supply unit.

Preferably, the heat generating unit includes a support bracket and a heating element coiled around the support bracket, and the support bracket is formed by two support plates mounted to each other.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
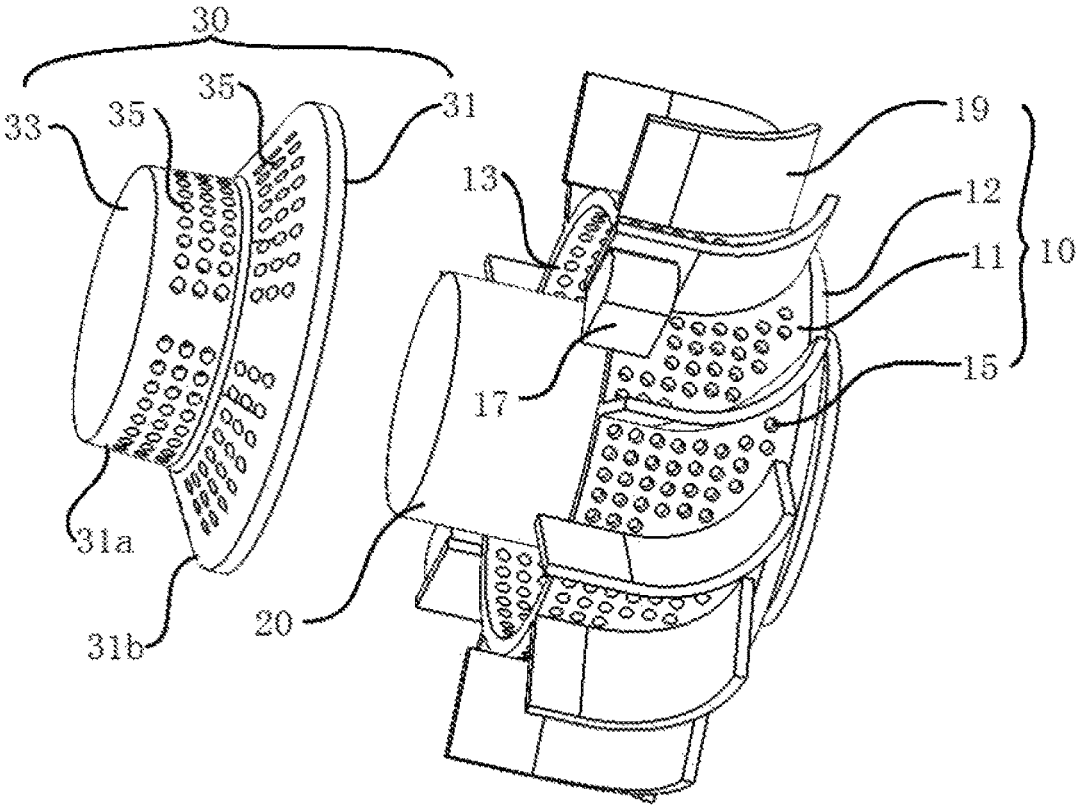
FIG. 1 is an exploded view of a noise reduction diffuser according to an embodiment of the present invention.

FIG. 1 shows a noise reduction diffuser according to a preferred embodiment of the present invention, in a form particularly suitable for use in an electric blower. The noise reduction diffuser includes a motor holder 10 and a rear cover 30.

The motor holder 10 includes a cylindrical sidewall 11 and a bottom portion 12 at one end of the sidewall 11. The other end of the sidewall 11 is formed with an opening 13 to allow a motor 20 to be mounted inside the sidewall 11. The motor 20 has an output shaft extending through the bottom portion 12 for driving an external load such as an impeller or fan. The sidewall 11 is formed with a plurality of first apertures 15. An inner diameter of the sidewall 11 is greater than an outer diameter of the motor 20, such that a gap is formed between the sidewall 11 and the motor 20. The first apertures 15 pass through the entire thickness of the sidewall 11 to be in communication with the gap. A plurality of smoothly curved guide vanes 19 is disposed on an outer circumference of the sidewall 11.

The rear cover 30 includes a circular bottom portion 33 and a conical sidewall 31 extending from the bottom portion 33. The sidewall 31 has an outer diameter that increases. The rear cover 30 is generally a hollow structure. An opening of the distal end of the sidewall 31 of the rear cover 30 has the same diameter as that of the opening 13 of the sidewall 11 of the motor holder 10, so that the rear cover 30 can be locked to the open end of the motor holder 10 and cooperate with the motor holder 10 to form a Helmholtz resonance cavity in which the motor 20 is mounted. The rear cover 30 is formed with a plurality of second apertures 35. In this embodiment, the sidewall 31 includes a first conical sidewall portion 31*a* and a second conical sidewall portion 31*b*. The first sidewall portion 31*a* extends from the bottom portion 33 and has an outer diameter that gradually increases, which is approximately in the form of a side surface of a conical frustum. The second sidewall portion 31*b* extends from a distal end of the first sidewall portion 31*a* and is also approximately in the form of a side surface of a conical frustum. In addition, a rate of increase in the outer diameter of the second sidewall portion 31*b* is greater than that of the first sidewall portion 31*a*, such that the rear cover overall is shaped like a hat. The second apertures 35 are distributed over the first sidewall portion 31*a* and second sidewall portion 31*b*.

In use, the fan is mounted on the shaft of the motor outside of the bottom portion 12 of the motor holder 10 and is driven by the motor 20 to generate an airflow. The airflow is guided by the guide vanes 19 toward the rear cover 30. After flowing across a junction of the motor holder 10 and the rear cover 30, the airflow is quickly diffused along the sidewall portion 31*b* and then further diffused along the sidewall portion 31*a*.

In this embodiment, a diameter of the bottom portion 33 of the rear cover 30 is less than the diameter of the opening 13 of the motor holder 10. The resonance frequency fr of the Helmholtz resonance cavity formed by the motor holder 10 and the rear cover 30 is calculated as follows:

$$f_r = \frac{c}{2\pi}\sqrt{\frac{p}{\delta_e \delta_1}}$$

where c is the speed of sound in the air;

δe is the thickness of the first aperture (or second aperture);

δ1 is the thickness of the internal space;

p is the open ratio, $p=N_kS_k/S_{ak}$, k is 1 or 2. When k is 1, $N_k$ represents the total number of the first apertures, $S_k$ represents the area of a single first aperture, and $N_kS_k$ represents the total area of the first apertures. When k is 2, $N_k$ represents the total number of the second apertures, $S_k$ represents the area of a single second aperture, and $N_kS_k$ represents the total area of the second apertures. $S_{ak}$ represents the outer surface area of the sidewall of the motor holder or the outer surface area of the sidewall of the rear cover. When k is 1, $S_{ak}$ represents the outer surface area of the sidewall of the motor holder, and when k is 2, $S_{ak}$ represents the outer surface area of the sidewall of the rear cover.

In this embodiment, $N_kS_k/S_k$=0.01~0.2, i.e. the ratio of the total area of the first apertures to the outer surface area of the sidewall of the motor holder is in the range of 0.01 to 0.2, or the ratio of the total area of the second apertures to the outer surface area of the sidewall of the rear cover is in the range of 0.01~0.2. In this embodiment, the first apertures 15 and the second apertures 35 have the same construction, i.e. each single first aperture and each second single second aperture have the same area; the thickness of the first apertures 15 and the second apertures 35 is 0.0005 to 0.005 m, for example, 0.002 m.

The noise reduction diffuser provided by the present invention uses the rear cover and the motor holder to form the Helmholtz resonance cavity thus effectively reducing the noise. This noise reduction diffuser can be used in appliances such as vent fans, hand dryers, or centrifugal fans. That is, the uses of the noise reduction diffuser in the vent fans, hand dryers or centrifugal fans fall within the scope of the present invention.

Figure 2:
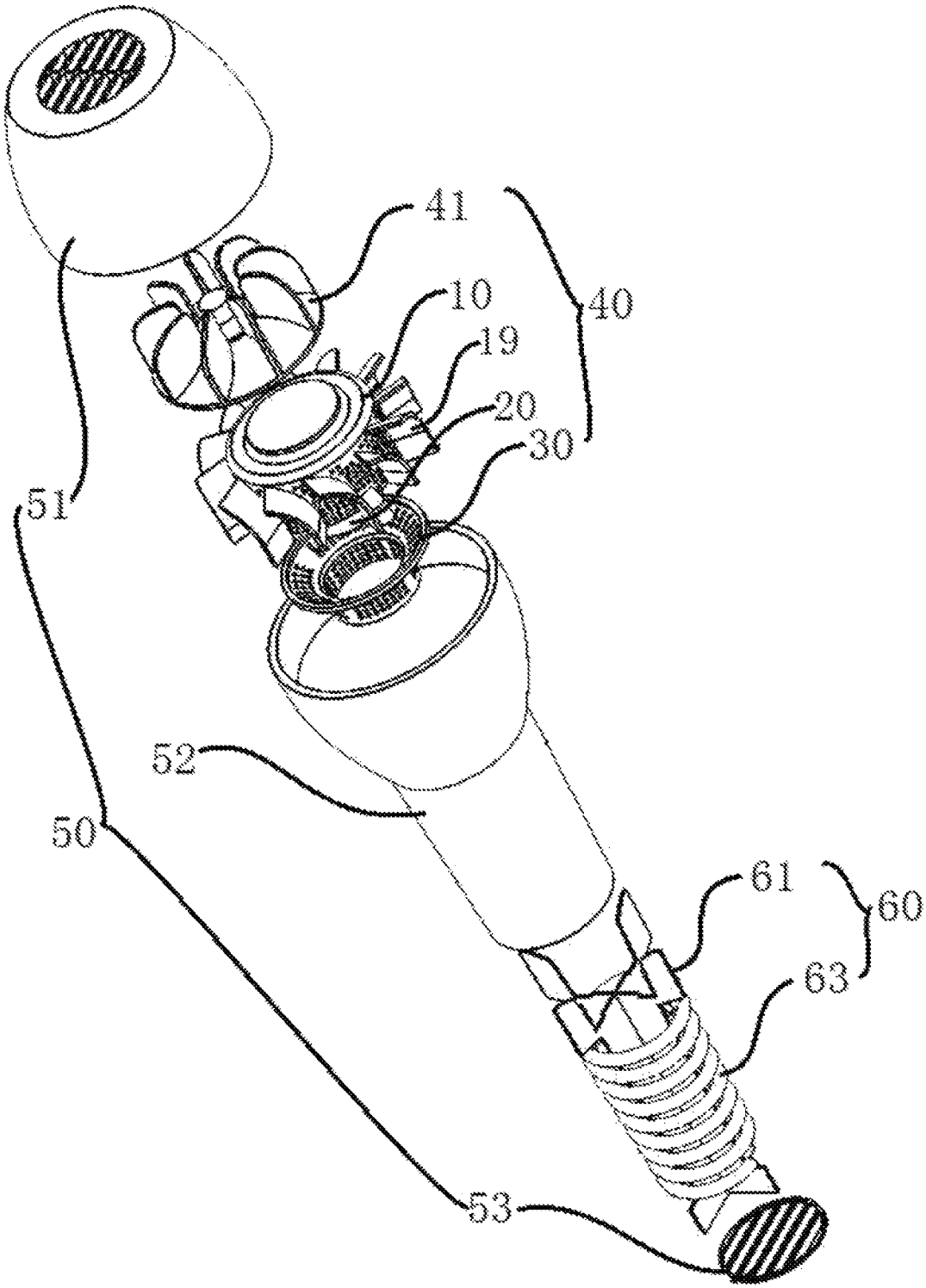
FIG. 2 is an exploded view of a noise reduction electric blower according to an embodiment of the present invention and incorporating the diffuser of FIG. 1.

Referring to FIG. 2, a noise reduced electric blower is also provided, which includes an outer housing 50, and a heat generating unit 60, an air supply unit 40, and a control unit (not shown in the figure) disposed in an interior of the outer housing. The air supply unit 40 includes the above described noise reduction diffuser, the motor mounted in the diffuser, and an impeller in the form of a fan 41 disposed at an outer end of the diffuser. The fan 41 is connected to the output shaft of the motor mounted in the noise reduction diffuser.

In this embodiment, the heat generating unit 60 includes a support bracket 61 and a heating element 63 coiled around a middle section of the support bracket 61. The support bracket 61 is formed by two support plates mounted to each other in the form of a cross. The support bracket 61 has opposite ends with greater diameter than the middle section so as to prevent the heating element 63 from sliding off the support bracket 61.

The outer housing 50 includes a first housing 51 and a second housing 52 that are interconnected. The first housing 51 covers an outer side of the impeller 41, and the second housing 52 covers the noise reduction diffuser and the heat generating unit 60. The motor holder 10 is fixedly mounted to an inner surface of the second housing 52, such that the second housing 52 provides support to the motor 20. An end of the first housing 51 has a through hole which serves as an air inlet. The outer housing 50 further includes a grille 53 disposed at a distal end of the second housing 52, which serves as an air outlet of the electric blower. A handle, not illustrated in the figure, may be provided on the outer housing 50. When necessary, one half of the handle may be disposed on the first housing 51, the other half may be disposed on the second outer housing 52, and the two halves are then assembled together.

Optionally, the second housing 52 and the motor holder 10 can be fixed to each other with screws. For example, referring to FIG. 1, the sidewall of the motor holder 10 is provided with a fixing site 17 which defines a screw hole therein for fastening with a screw.

When the motor 20 rotates the fan 41, the airflow enters the first housing 51 via the inlet and flows outwardly from the center of the fan 41. The airflow is then guided by the guide vanes 19 of the motor holder 10 to the rear cover 30 of the diffuser for being diffused and moved forward along an inner chamber of the second housing 52. The airflow is finally discharged out of the air outlet after being heated by the heating element 63.

Table 1 below illustrates the comparison between various parameters of the conventional electric blower and the present electric blower under the same rotational speed. The noise at the inlet is measured in an area at a 300 mm distance from the inlet, and the noise at the outlet is measured in an area at a 300 mm distance from the outlet. As can be seen, the electric blower of the present invention can achieve the same rotational speed at a lower motor current and lower motor voltage, and can effectively reduce the noise.

TABLE 1

Comparison between conventional blower and the present blower under the same rotation speed

| | Rotational speed (rpm) | Motor current (A) | Motor voltage (DCV) | Airflow speed (ft/min) | Inlet Noise (db) | Outlet Noise (db) |
|---|---|---|---|---|---|---|
| Prior art | 13600 | 1.78 | 25.0 | 573.4 | 80.8 | 77.8 |
| The present invention | 13600 | 1.70 | 24.5 | 564.7 | 77.7 | 76.8 |
| Noise improvement | | | | | 3.1 | 1.0 |

Table 2 below illustrates the comparison between the noise values of the conventional electric blower and the present electric blower under the same rotational speed. Likewise, the noise at the inlet is measured in an area at a 300 mm distance from the inlet, and the noise at the outlet is measured in an area at a 300 mm distance from the outlet. As can be seen, the electric blower of the present invention can effectively reduce the noise.

TABLE 2

Comparison between conventional blower and the present blower under the same rotation speed

| | Airflow speed (ft/min) | Noise inlet (db) | Noise outlet (db) |
|---|---|---|---|
| Prior art | 564.7 | 79.8 | 77.5 |
| The present invention | 564.7 | 77.7 | 76.8 |
| Noise improvement | | 2.1 | 0.7 |

The present invention provides a noise reduction diffuser and a noise reduced electric blower. The motor holder is provided with the first apertures. The rear cover formed with the second apertures is added, which cooperates with the motor holder to form the Helmholtz resonance cavity, thereby effectively reducing the noise and making the blower more energy-saving.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. A noise reduction diffuser, comprising:

a motor holder including: a cylindrical sidewall having a first end and a second end; a bottom portion at the first end of the sidewall; an opening formed in the second end of the sidewall for allowing a motor to be mounted inside the sidewall; and a plurality of guide vanes is disposed on the sidewall of the motor holder, for guiding airflow over the cylindrical sidewall of the motor holder; and a rear cover having a bottom portion and a conical sidewall extending from the bottom portion, the conical sidewall has an outer diameter that increases away from the bottom portion, an open end of the conical sidewall is fixed to and closes the opening of the second end of the cylindrical sidewall of the motor holder, wherein the rear cover cooperates with the motor holder to form a Helmholtz resonance cavity.

2. The noise reduction diffuser of claim 1, wherein the sidewall of the motor holder is formed with a plurality of first apertures.

3. The noise reduction diffuser of claim 2, wherein the sidewall of the rear cover is formed with a plurality of second apertures.

4. The noise reduction diffuser of claim 2, wherein an inner diameter of the sidewall of the motor holder is greater than an outer diameter of a motor to be mounted inside the sidewall, such that a gap is formed between the sidewall of the motor holder and the motor, and the first apertures pass through an entire thickness of the sidewall of the motor holder to be in communication with the gap.

5. The noise reduction diffuser of claim 3, wherein a thickness of each of the first apertures and the second apertures is 0.0005 to 0.005 m.

6. The noise reduction diffuser of claim 3, wherein the first apertures and the second apertures satisfy the following conditions: $N_kS_k/S_a$=0.01~0.2, k is 1 or 2, $N_k$ represents the number of the apertures, and $S_k$ represents the area of a single second aperture; when k is 1, $S_{ak}$ represents an outer surface area of the sidewall of the motor holder, and $N_kS_k$ represents the total area of the first apertures; when k is 2, $N_kS_k$ represents the total area of the second apertures, and $S_{ak}$ represents an outer surface area of the sidewall of the rear cover.

7. The noise reduction diffuser of claim 1, wherein the conical sidewall of the rear cover includes a first sidewall portion and a second sidewall portion that are interconnected to each other, the first sidewall portion extends from the bottom portion of the rear cover and has an outer diameter that gradually increases, the second sidewall portion extends from a distal end of the first sidewall portion and has an outer diameter that gradually increases, and a rate of increase of the outer diameter of the second sidewall portion is greater than that of the first sidewall portion, such that the rear cover overall is shaped like a hat.

8. An electric blower comprising: an outer housing, and an air supply unit disposed inside the outer housing, wherein the air supply unit comprises: the noise reduction diffuser of claim 1;

a motor mounted in the diffuser; and an impeller disposed at an outer end of the diffuser, and driven by the motor.

9. The electric blower of claim 8, further comprising a heat generating unit disposed inside the outer housing, wherein the heat generating unit is configured to heat an airflow produced by the air supply unit.

10. The electric blower of claim 9, wherein the heat generating unit includes a support bracket and a heating element coiled around the support bracket, and the support bracket is formed by two support plates mounted to each other.

11. The electric blower of claim 10, wherein the support bracket has opposite ends with a diameter greater than a middle section thereof so as to prevent the heating element from sliding off the support bracket.

12. The electric blower of claim 8, wherein the sidewall of the motor holder is formed with a plurality of first apertures.

13. The electric blower of claim 12, wherein an inner diameter of the sidewall of the motor holder is greater than an outer diameter of the motor, such that a gap is formed between the sidewall of the motor holder and the motor, and the first apertures pass through an entire thickness of the sidewall of the motor holder to be in communication with the gap.

14. The electric blower of claim 12, wherein the sidewall of the rear cover is formed with a plurality of second apertures.

15. The electric blower of claim 14, wherein a thickness of each of the first apertures and the second apertures is 0.0005 to 0.005 m.

16. The electric blower of claim 14, wherein the first apertures and the second apertures satisfy the following conditions: $N_kS_k/S_a$=0.01~0.2, k is 1 or 2, $N_k$ represents the number of the apertures, and $S_k$ represents the area of a single second aperture; when k is 1, $S_{ak}$ represents an outer surface area of the sidewall of the motor holder, and $N_kS_k$ represents the total area of the first apertures; when k is 2, $N_kS_k$ represents the total area of the second apertures, and $S_{ak}$ represents an outer surface area of the sidewall of the rear cover.

17. The electric blower of claim 8, wherein the conical sidewall of the rear cover includes a first sidewall portion and a second sidewall portion that are interconnected to each other, the first sidewall portion extends from the bottom portion of the rear cover and has an outer diameter that gradually increases, the second sidewall portion extends from a distal end of the first sidewall portion and has an outer diameter that gradually increases, and a rate of increase of the outer diameter of the second sidewall portion is greater than that of the first sidewall portion, such that the rear cover overall is shaped like a hat.

* * * * *